US005857374A

United States Patent [19]

Stodd

[11] Patent Number: 5,857,374

[45] Date of Patent: Jan. 12, 1999

[54] METHOD AND APPARATUS FOR FORMING A CAN SHELL

[76] Inventor: Ralph P. Stodd, 6450 Poe Ave. Suite 509, Dayton, Ohio 45414

[21] Appl. No.: 751,262

[22] Filed: Nov. 18, 1996

Related U.S. Application Data

[63] Continuation-in-part of Ser. No. 565,961, Dec. 4, 1995, Pat. No. 5,634,366, which is a continuation-in-part of Ser. No. 239,715, May 9, 1994, Pat. No. 5,502,995, which is a continuation-in-part of Ser. No. 55,274, May 3, 1993, Pat. No. 5,309,749, said Ser. No. 757,262, Nov. 18, 1996, Pat. No. 5,857,374, is a continuation-in-part of Ser. No. 516,555, Aug. 18, 1995, Pat. No. 5,575,170, which is a continuation of Ser. No. 184,969, Jan. 21, 1994, Pat. No. 5,442,947, which is a continuation-in-part of Ser. No. 30,777, Mar. 12, 1993, abandoned.

[51] Int. Cl.[6] ..... B21D 22/21; B21C 37/02

[52] U.S. Cl. ..... 72/348; 72/379.2

[58] Field of Search ..... 72/329, 339, 336, 72/347, 348, 404, 379.2, 405.9, 335, 350, 351; 469/13

[56] References Cited

U.S. PATENT DOCUMENTS

| | | | |
|---|---|---|---|
| 3,115,678 | 12/1963 | Keen . | |
| 3,194,047 | 7/1965 | Eggert . | |
| 3,196,817 | 7/1965 | Fraze . | |
| 3,251,319 | 5/1966 | Kaupert . | |
| 3,557,599 | 1/1971 | Eickenhorst . | |
| 3,695,088 | 10/1972 | Alvi . | |
| 3,924,437 | 12/1975 | Hortig . | |
| 4,020,670 | 5/1977 | Bulso . | |
| 4,248,076 | 2/1981 | Bulso . | |
| 4,414,836 | 11/1983 | Saunders . | |
| 4,416,140 | 11/1983 | Bulso . | |
| 4,471,644 | 9/1984 | Kimbell . | |
| 4,550,588 | 11/1985 | Abe . | |
| 4,587,826 | 5/1986 | Bulso, Jr. et al. . | |
| 4,637,961 | 1/1987 | Bachmann et al. . | |
| 4,715,208 | 12/1987 | Bulso, Jr. et al. . | |
| 4,800,743 | 1/1989 | Bulso, Jr. et al. . | |
| 4,865,506 | 9/1989 | Kaminski . | |
| 4,955,223 | 9/1990 | Stodd et al. | 72/336 |
| 5,042,284 | 8/1991 | Stodd et al. . | |
| 5,069,057 | 12/1991 | Lee . | |
| 5,309,749 | 5/1994 | Stodd . | |
| 5,356,256 | 10/1994 | Turner et al. . | |
| 5,442,947 | 8/1995 | Stodd | 72/336 |
| 5,502,995 | 4/1996 | Stodd . | |
| 5,575,170 | 11/1996 | Stodd | 72/336 |

FOREIGN PATENT DOCUMENTS

| | | |
|---|---|---|
| 282731 | 12/1987 | Japan . |

*Primary Examiner*—Joseph J. Hail, III
*Assistant Examiner*—Rodney Butler
*Attorney, Agent, or Firm*—Jacox, Meckstroth & Jenkins

[57] ABSTRACT

A mechanical press receives can shell tooling having multiple stages each including a plurality of shell forming stations. Each station has an annular blank die which forms a sheet metal disk, and a peripheral portion of each disk is gripped between the blank die and a lower pressure sleeve. The peripheral portion of each disk is shifted downwardly relative to a center portion of the disk to start the forming of a center panel within the disk between an annular nose portion of an air pressurized die center and an air pressurized panel punch. The peripheral portion is also gripped between an air pressurized lower die core ring and an air pressurized upper sleeve which cooperate to form a crown and a depending lip. The center panel of each disk is shifted downwardly by the die center and the panel punch for forming a chuckwall against the die core ring and to start a countersink by wrapping the metal around the nose portion of the die center. As the die center and upper sleeve bottom are moving upwardly, a substantially cylindrical panel wall is formed between the nose portion of the die center and the panel punch, and the countersink is precisely formed around the nose portion. The lower tooling at each stage is positioned at a slightly different elevation so that the upper tooling contacts the lower tooling at staggered or sequential time intervals for significantly reducing the dynamic loading on the press.

13 Claims, 4 Drawing Sheets

(STAGE 1)

(STAGE 4)

METHOD AND APPARATUS FOR FORMING A CAN SHELL

RELATED APPLICATIONS

This application is a continuation-in-part of application Ser. No. 08/565,961, filed Dec. 4, 1995, U.S. Pat. No. 5,634,366, which is a continuation-in-part of application Ser. No. 08/239,715, filed May 9, 1994, U.S. Pat. No. 5,502,995, which is a continuation-in-part of application Ser. No. 08/055,274, filed May 3, 1993, U.S. Pat. No. 5,309,749. Said application Ser. No. 08/757/762 filed Nov. 18, 1996 now U.S. Pat. No. 5,857,374. This application is also a continuation-in-part of application Ser. No. 08/516,555, filed Aug. 18, 1995 now U.S. Pat. No. 5,575,170, which is a continuation of application Ser. No. 08/184,969, filed Jan. 21, 1994, U.S. Pat. No. 5,442,947, which is a continuation-in-part of application Ser. No. 08/030,777, filed Mar. 12, 1993, abandoned.

BACKGROUND OF THE INVENTION

In apparatus or tooling for forming end panels or shells for metal cans or plastic containers, for example, as disclosed in U.S. Pat. No. 5,042,284 of which applicant is a co-inventor, it is desirable to construct the tooling so that the shells are produced from sheet metal or aluminum having a minimum gage or thickness. On the other hand, it is necessary for each shell to have sufficient strength for withstanding a predetermined pressure within the can without deforming or buckling. It is also desirable for the tooling to provide for high volume production of the shells on either a single or multiple action press and to complete the forming of each shell at a single station in order to avoid complicated reforming operations. Commonly, an end panel or shell includes a circular center panel which is connected by a panel radius and an annular panel wall to a U-shaped countersink portion having a countersink radius. The countersink portion is connected by a tapering or frusto-conical chuckwall portion to an upper crown portion which extends outwardly to a depending peripheral lip portion.

One of the common problems encountered in producing end panels or shells is the stretching and thinning of the sheet metal when forming a small panel radius and a small countersink radius. If there is stretching and thinning of the sheet metal in these areas, the strength of the shell rapidly decreases, with the result that the shells are unacceptable for use. The stretching and thinning of the sheet metal around the panel radius and countersink radius can result from tooling which draws the chuckwall and center panel from the sheet metal.

The center panel wall and the countersink have also been formed after drawing the chuckwall, for example, as disclosed in U.S. Pat. No. 4,715,208. In this patent, the center panel is moved upwardly with the die center and panel punch after the chuckwall is formed. However, this method does not provide for a uniform countersink radius or a small panel radius or a cylindrical panel wall of maximum length, each of which is important for producing a high strength shell with a sheet material of minimum thickness. Other forms of tooling and method for producing shells are disclosed in U.S. Pat. No. 4,637,961. In this patent, the chuckwall is formed at one tooling station and then the center panel, panel wall and countersink are formed at a second tooling station.

There is also a problem of forming shells to precision dimensions and specifications when a high speed mechanical press is starting up production and the press and tooling are cool or at room temperature. That is, as the press warms up with operation, the press dynamics and the thermal expansion of the press components change so that the desired precision dimension from the top of the crown portion to the bottom of the countersink portion changes. This condition may be corrected by stopping the press after the press and tooling have arrived at operating temperature and then readjust the ram so that it bottoms at a slightly different height in order to produce shells according to specification. However, it is very undesirable to shut down a high production can producing press after it has arrived at operating temperature in order to make such an adjustment. Also when the tooling is constructed to produce a large number of shells with each press stroke, for example, 24 shells, the dynamic loading on the press may overload the press if the speed of the press is increased.

SUMMARY OF THE INVENTION

The present invention is directed to an improved method and apparatus for efficiently producing end panels or shells for cans and other containers and which is adapted for use on either a single or multiple action press for completely forming each shell at a corresponding tooling station. The method and apparatus of the invention provide for significantly reducing the thickness or gage of the sheet metal used for producing the shells by avoiding stretching and thinning of the sheet metal around each radius, especially the panel radius and the countersink radius. In addition, the invention reduces the dynamic loading on the press so that the press may be operated at a higher speed, and further provides for precisely maintaining uniform dimensions of the shell while obtaining a substantially cylindrical panel wall and a straight chuckwall in axial cross-section to obtain a shell with a maximum strength/weight ratio.

The above advantages and features are provided by a tooling assembly or system which first blanks a disk at each tooling station from a thin metal sheet and then grips and shifts a peripheral portion of the disk axially or downwardly relative to a center portion of the disk. The center portion is pressed between a pressurized panel punch and an annular nose portion of a pressurized die center to define a center panel with a panel radius and a generally frusto-conical intermediate wall portion connecting the center panel to the peripheral portion. An inner part of the peripheral portion of each disk is gripped between a die core ring and an upper pressure sleeve for defining a crown portion, and an outer part of the peripheral portion is formed into a lip portion depending from the crown portion.

The center panel portion of each disk is shifted axially or downwardly relative to the die core ring and in a direction to reverse bend the intermediate wall portion and to wrap it around the nose portion and wipe it against tapered and cylindrical surfaces of the die core ring to form a reinforced chuckwall portion having an inwardly projecting annular bow or ridge. After the die center and upper pressure sleeve bottom at each station and begin moving upwardly, the pressurized panel punch presses the center panel into a cavity defined by the nose portion of the die center to iron or coin a cylindrical panel wall having a thickness less than metal thickness and to form a countersink with a precision radius. This method also eliminates stretching and thinning of the metal around the panel radius and the countersink radius.

The tooling of the invention also produces shells by sequencing the tooling at different stages each having a plurality of tooling stations to reduce dynamic loading on the press. In addition, the tooling forms shells precisely to the desired dimensions or specifications, even during start up of the press. As a result, the tooling eliminates overloading the press and the need to shut down the press after the press and tooling have arrived at the operating temperature in order to adjust the press ram to compensate for thermal expansion of the press and for changes in press dynamics.

Other features and advantages of the invention will be apparent from the following description, the accompanying drawings and the appended claims.

DESCRIPTION OF THE PREFERRED EMBODIMENTS

Figure 13:
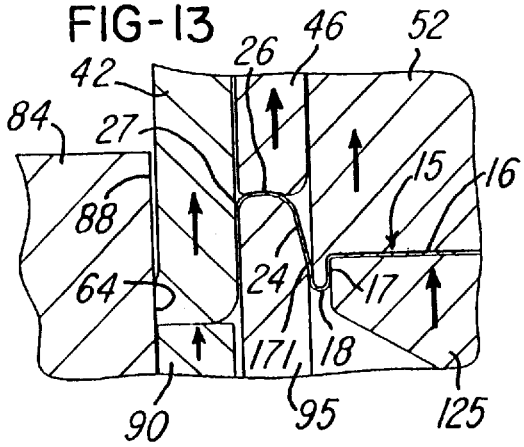

Referring to the drawings, FIG. 13 shows an enlarged shell 15 which is formed from aluminum having a thickness of about 0.0088 inch or less. The shell 15 includes a circular center panel portion 16 which is connected by a substantially cylindrical panel wall portion 17 to an annular countersink portion 18 having a U-shaped cross-sectional configuration. The countersink portion 18 has a uniform countersink radius 21 (FIG. 14) of about 0.020", and a panel radius 22 of about 0.013" connects the center panel portion 16 and the cylindrical panel wall portion 17. A tapered annular chuckwall portion 24 connects the countersink portion 18 to a crown portion 26, and a peripheral lip portion 27 depends from the crown portion 26.

Figure 1:
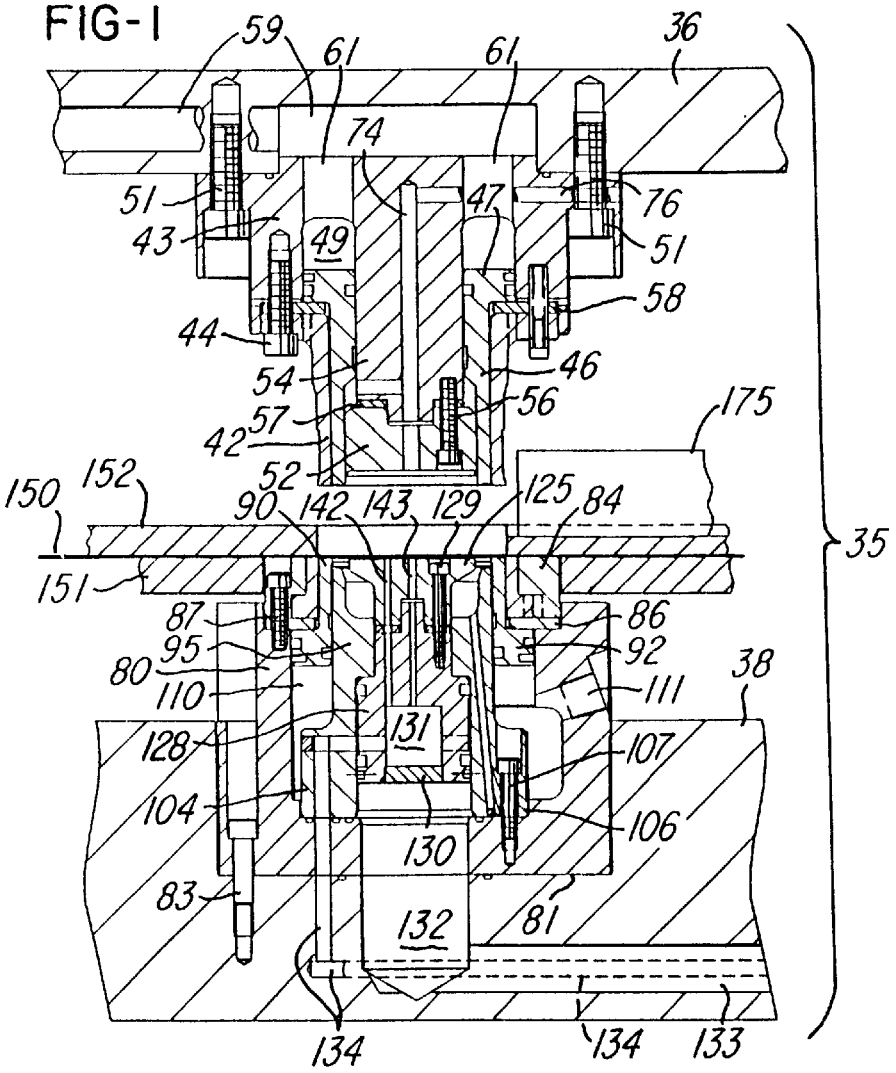
FIG. 1 is an axial section of a tooling assembly or station constructed and operated in accordance with the invention.

FIG. 1 illustrates a single station of a multiple station tooling assembly 35, for example, a 22 or 24 out tooling system. One shell 15 is produced at each station during each stroke of a conventional high speed single action or multiple action mechanical press. The tooling system or assembly 35 mounts on an upper die shoe 36 and a lower die shoe 38 which are supported by the press bed and/or bolster plates and the ram within the press. An annular blank and draw die 42 has an upper flange portion secured to a retainer or riser body 43 by a set of peripherally spaced screws 44, and the die 42 surrounds an upper pressure sleeve 46. The sleeve 46 has an upper piston portion 47 slidably supported within a chamber 49 defined within the riser body 43. A set of screws 51 secure the riser body to the upper die shoe 36. An inner die member or die center 52 is supported within the upper pressure sleeve 46 by a cylindrical die center riser 54 which is formed as part of the riser body 43. A set of screws 56 secure the die center 52 to the riser 54, and a flat annular spacer 57 is positioned between the die center 52 and riser 54. Another annular spacer 58 is located between the blank and draw die 42 and the riser body 43 and forms a bottom stop for the upper pressure sleeve piston 47. A passage 59 within the upper die shoe 36 directs low pressure air of about 20 to 40 p.s.i. to the chamber 49 through passages 61 within the riser body 43.

Figure 2:
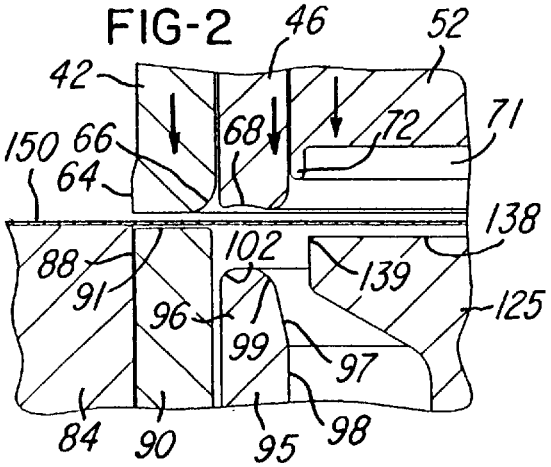
FIGS. 2–13 are enlarged fragmentary sections of the tooling assembly shown in FIG. 1 and illustrating the progressive steps for producing a shell at each station in accordance with the invention.

As shown in FIG. 2, the blank and draw die 42 has a cylindrical lower cutting edge 64 and an inner curved forming surface 66. The lower end of the upper pressure sleeve 46 has a contoured annular forming surface 68, and the lower end of the die center 52 has a circular recess or cavity 71 defined by an annular projection or nose portion 72. The projection 72 has a curved bottom surface with a radius preferably between 0.015" and 0.020". As also shown in FIG. 1, a center axially extending vent passage 74 is formed within the center of the die center 52 and riser 54 and connects with a radial vent passage 76 within the riser body 43.

An annular die retainer 80 is mounted on the lower die shoe 38 within a circular counterbore 81 and is secured to the lower die shoe by circumferentially spaced screws 83. An annular cut edge die 84 with a hardened insert is secured with a spacer washer 86 to the retainer 80 by peripherally spaced screws 87 and has an inner cylindrical cutting edge 88 (FIG. 2) with substantially the same diameter as the cutting edge 64 on the blank and draw die 42. An annular lower pressure sleeve 90 includes a lower piston portion 92 (FIG. 1) supported for sliding movement within the retainer 80, and the sleeve 90 has a flat upper end surface 91 (FIG. 2) which opposes the bottom surface of the blank and draw die 42.

A die core ring 95 is positioned within the lower pressure sleeve 90 and has an upper end portion 96 (FIG. 2) with an inner frusto-conical or tapered surface 97 extending to a cylindrical surface 98, an inner rounded surface 99 and an outer rounded surface 102. The die core ring 95 also has a base portion 104 (FIG. 1) which is received within a counter bore or recess 106 formed within the retainer 80. The base portion 104 is secured to the die retainer 80 by a set of four circumferentially spaced screws 107. An annular chamber 110 is defined within the die retainer 80 around the die core ring 95 for receiving the piston portion 92 of the lower pressure sleeve 90, and low pressure air of about 40 p.s.i. is supplied to the chamber 110 through a passage 111 connected to an air supply line.

A circular panel punch 125 (FIG. 1) is positioned within the die core ring 95 and is secured to a panel punch piston 128 by a set of screws 129. The panel punch piston 128 is supported for axial movement within the die core ring 95, and the lower end of the piston 128 is closed by a plate 130 to define a chamber 131 within the piston. High pressure air, on the order of 400 p.s.i., is supplied to a chamber 132 under the piston 128 through a laterally extending passage 133 within the lower die shoe 38. A low pressure air supply passage 134 also extends within the lower die shoe 38 and through the die retainer 80 and base portion 104 of the die core ring 95 to the chamber 131 within the piston 128 for the panel punch 125.

Referring to FIG. 2, the panel punch 125 has a circular flat upper surface 138 which extends to a peripheral surface 139 having a small panel radius of about 0.013" or less. The panel punch 125 also has a set of three circumferentially spaced and axially extending air passages 142 (FIG. 1) and a center air passage 143 which extend into the chamber 131 within the panel punch piston 128.

Figure 3:
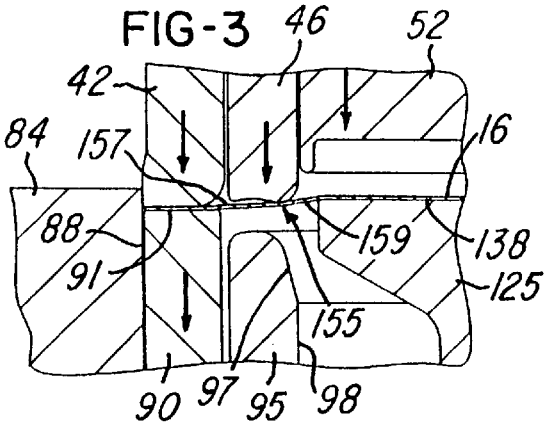
Figure 4:
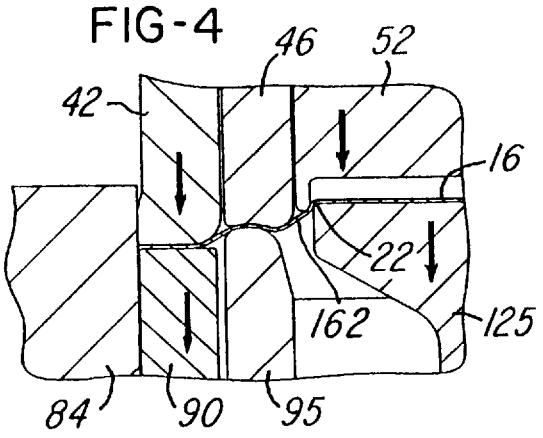
Figure 5:
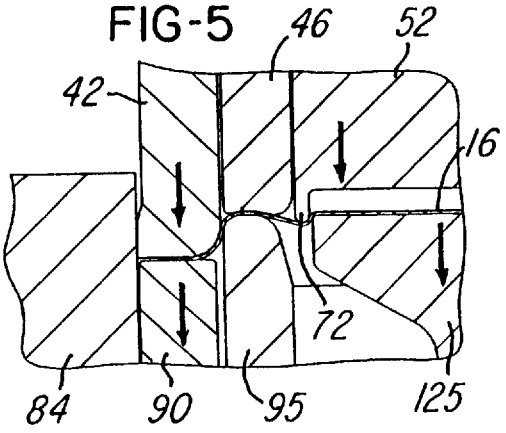
Figure 6:
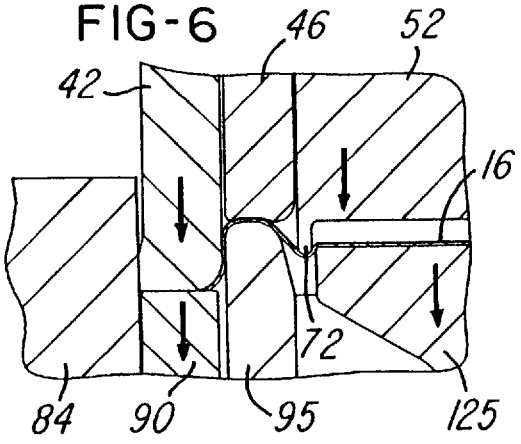
Figure 7:
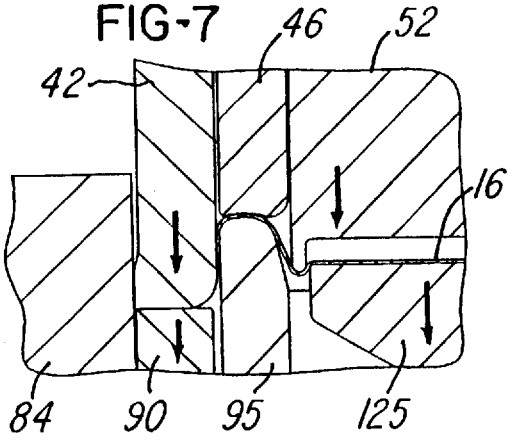
Figure 8:
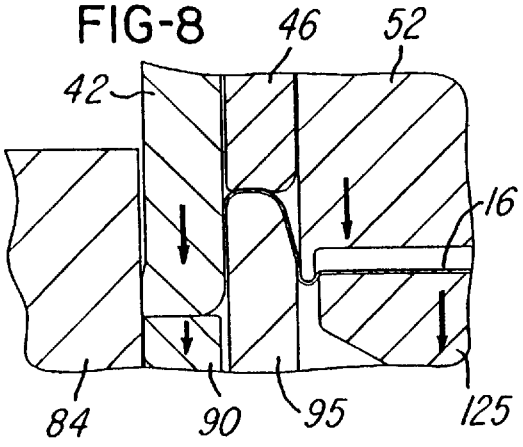

The operation of the tooling system or assembly 35 for successively forming shells 15 at each station, is now described in connection with FIGS. 2–13. As shown in FIGS. 1 & 2, a continuous strip or sheet 150 of aluminum having a thickness of about 0.0088", is fed on a stock plate 151 across the cut edge die 84 and below a stripper plate 152. When the upper die shoe 36 moves downwardly, the mating shearing edges 64 and 88 (FIG. 2) blank out a circular disk 155 (FIG. 3). As the blank and draw die 42 continues to move downwardly (FIG. 3), a peripheral edge portion 157 of the disk 155 is confined between the blank die 42 and the upper surface 91 end of the lower pressure sleeve 90. As the upper pressure sleeve 46 moves downwardly with the blank and draw die 42 (FIG. 2), an annular intermediate portion 159 of the disk 155 begins to wrap around the peripheral edge surface 139 of the panel punch 125. The air pressure below the lower pressure sleeve 90 is selected to produce a predetermined clamping or gripping pressure against the peripheral portion 157 of the disk 155 and to allow the peripheral portion 157 to slide radially inwardly between the blank die 42 and lower pressure sleeve 90, as shown in FIGS. 3–5.

As the blank and draw die 42 and upper pressure sleeve 46 continue to move downwardly (FIG. 4), an inner part of the intermediate portion 159 of the disk 155 forms into a frusto-conical portion 162, and the portion 162 starts to wrap around the slightly rounded edge 139 of the panel punch 125 so that the center panel 16 is defined on top of the panel punch. As a result of a small clearance of less than 0.005" and about 0.001"–0.002" over metal thickness between the outer cylindrical surface of the panel punch 125 and the inner cylindrical surface of the nose portion 72 of the die center 52, or as a result of an interference fit, as will be explained later, the panel 16 does not continue further into the cavity 71.

As the die center 52 and panel punch move further downwardly with the blank and draw die 42 (FIGS. 5–9), the material wraps around the downwardly projecting nose portion 72 of the die center 52 and slides down the tapered wall surface 97 of the die core ring 95 and slides between the upper pressure sleeve 46 and the die core ring 95 and between the blank and draw die 42 and die core ring 95 to form the crown 26, lip 27 and chuckwall 24 of the shell 15.

Figure 9:
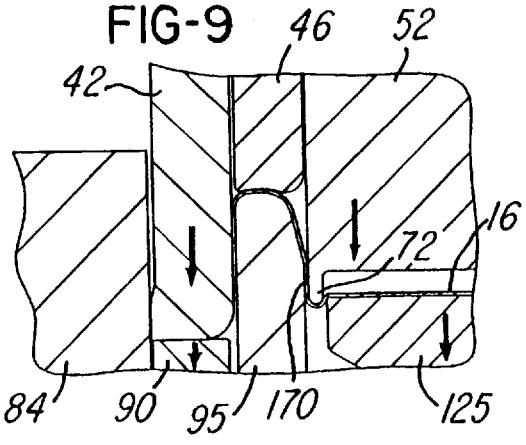
Figure 10:
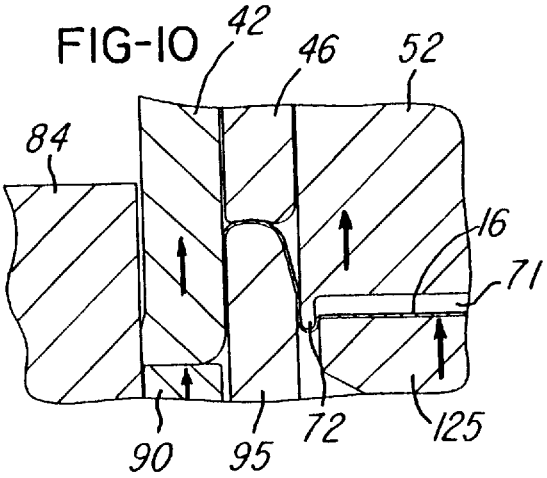
Figure 11:
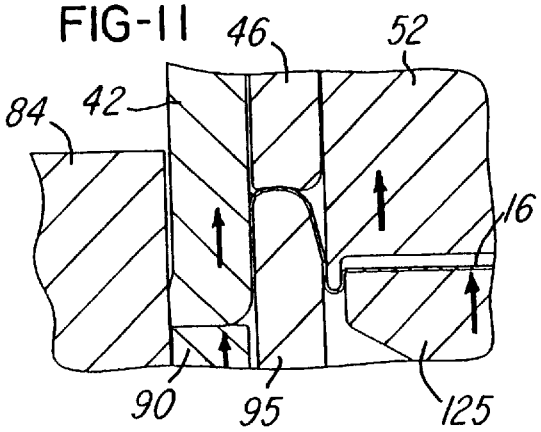
Figure 12:
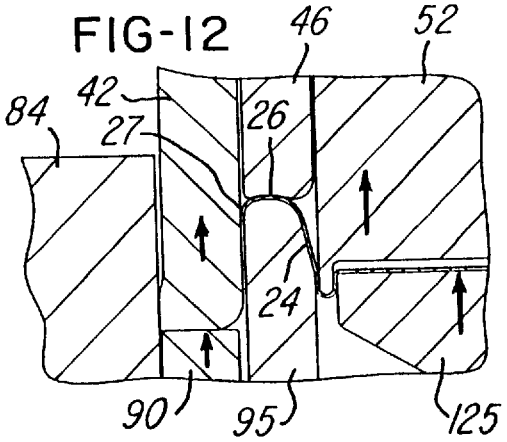

As also shown in FIG. 9, as a result of the further downward movement of the die center 52 and the small clearance over metal of less than 0.005" and about 0.001"–0.002" between the outer cylindrical surface of the nose portion 72 and the inner cylindrical surface 98 of the die core ring 95, the chuckwall 24 continues further downwardly to form a cylindrical portion 170 which cooperates with the tapered portion 24 to form an annular bow or ridge 171 within the chuckwall when the die center 52 and panel punch 125 bottom at their closed positions.

Referring to FIGS. 10–13, as the upper die shoe 36 and the die center 52 reverse and move upwardly, the metal forming the cylindrical portion 170 rolls around the nose portion 72 of the die center 52, and the upward pressure on the panel punch 125 moves the center panel upwardly within the cavity 71 until the center panel 16 engages the bottom surface of the die center 52. The radial space between the outer cylindrical surface of the panel punch 125 and the inner cylindrical surface of the nose portion 72 may be between 0.0005 and 0.0015 inch less than the metal thickness. Thus as the metal rolls around the nose portion 72 of the die center 52, the cylindrical panel wall 17 is ironed or coined between the outer surface of the panel punch 125 and the inner surface of the die center nose portion 72 to form a reduced wall thickness. As also apparent in FIG. 13, after the panel wall 17 and countersink 18 are formed, the chuckwall 24 still includes the inwardly projecting annular bow or ridge 171.

After a shell 15 is completed (FIG. 13) and the upper die shoe 36 is moving upwardly, the shell 15 is retained by friction within the blank and draw die 42. The shell 15 is released from the die center 52 by downward movement of the upper pressure sleeve 46 and venting through the passages 74 and 76. While the upper die shoe 36 is moving upwardly, pressurized jets of air are directed upwardly from the air passages 142 and 143 so that the shell 15 is held against the bottom surface 68 of the upper pressure sleeve 46. When the blank and draw die 42 arrive at a predetermined elevation and the panel punch piston 128 stops upward movement within the die core ring 125, the upper pressure sleeve 46 and shell 15 are shifted downwardly to the starting position, and the shell 15 is released by the vent passage 74 so that the shell 15 is free for lateral ejection or discharge into a guide chute 175 (FIG. 1) by a jet of air from a nozzle (not shown) connected to a pressurized air supply.

Figure 14:
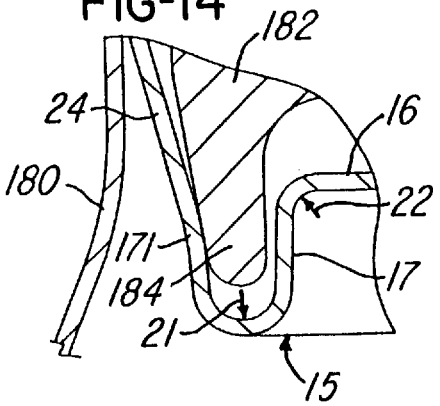
FIGS. 14 and 15 are enlarged fragmentary sections of the final shell shown in FIG. 13 and illustrating a subsequent step of deforming the shell while it is being seamed to a can.
Figure 15:
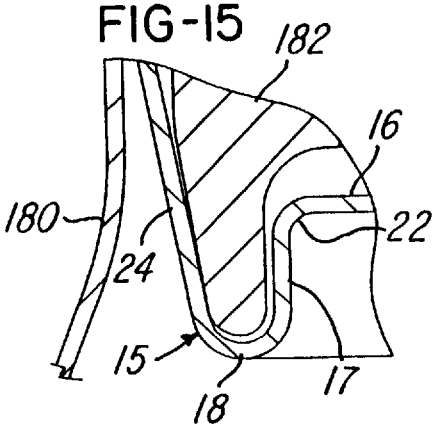

Referring to FIGS. 14 & 15, when the shell 15 is being attached to the neck or upper end portion 180 of a one-piece aluminum can by a seamer machine, a seamer chuck 182 with a depending annular nose portion 184 is brought into engagement with the shell 15 so that the seamer chuck portion 184 engages the inwardly projecting bow or ridge portion 171 of the chuckwall 24. The chuck portion 184 presses radially outwardly on the ridge portion 171 so that the chuckwall 24 becomes substantially straight in axial cross-section (FIG. 15), and the coined panel wall 17 moves to a cylindrical configuration (FIG. 15) to obtain the maximum strength/weight ratio for the shell 15.

Figure 16:
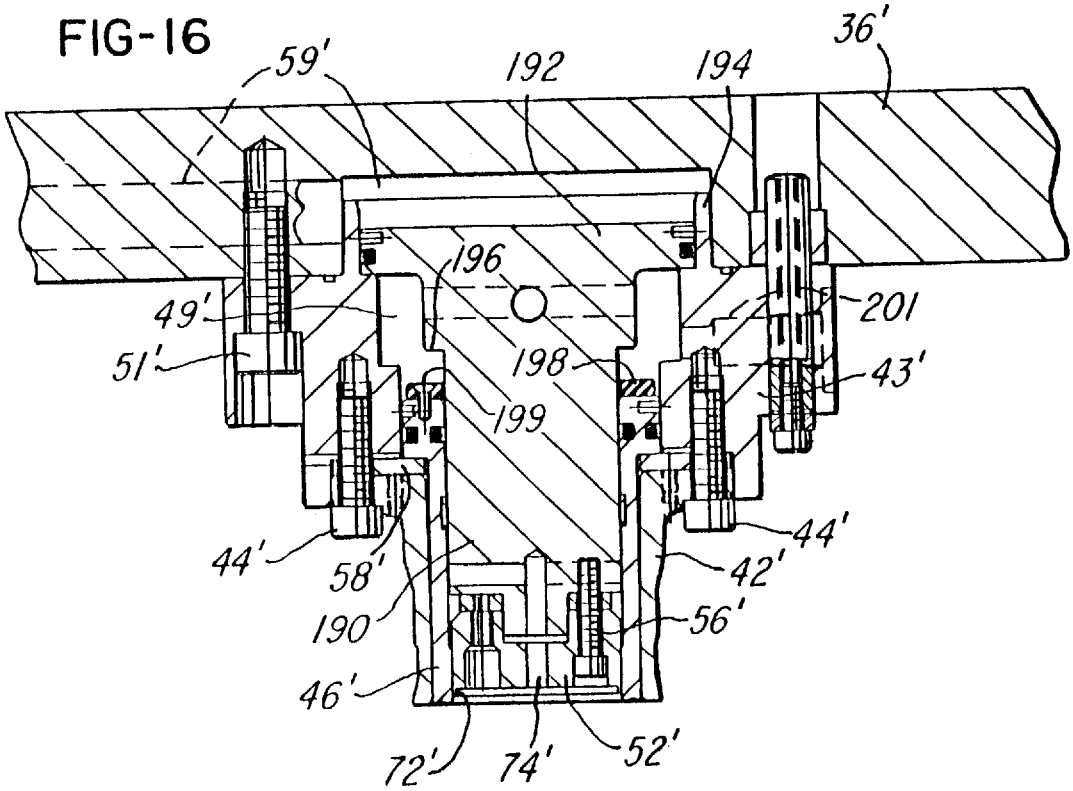
FIG. 16 is an axial section of a modified upper tooling assembly similar to that shown in FIG. 1 at each station and constructed in accordance with another embodiment of the invention.

FIG. 16 shows a modification of the upper tooling described above in connection with FIG. 1 for each station and with corresponding tooling components or parts identified with the same reference numbers but with the addition of prime marks. Thus in the embodiment shown in FIG. 16, the die center 52' is supported and carried by a die center piston 190 to which the die center 52' is secured by a set of screws 56'. The die center piston 190 extends upwardly within the upper piston or second pressure sleeve 46' and includes a stepped head portion 192 which is slidably supported within a cylinder portion 194 formed as part of the piston retainer body 43'. The cylinder portion 194 projects upwardly into the air pressure chamber or passage 59' formed within the upper die shoe 36'. The upper portion of the die center piston 190 has an outwardly projecting annular shoulder 196, and a hardened steel annular spacer 198 is secured to the upper end of the upper pressure sleeve 46' by a peripherally spaced screws 199. The pressurized air for the annular chamber 49' above the upper pressure sleeve 46' is received through a radial passage 201 connected to a suitable pressurized air supply line (not shown). In place of the pressurized air within the chamber 59', compression springs may be used between the die shoe 36' and the piston or member 190.

The modified upper tooling shown in FIG. 16 is used with the lower tooling shown in FIG. 1 at each station. In operation, when the upper die shoe 36' has reached the bottom of its stroke, the blank and draw die 42', pressure sleeve 46' and die center 52' are in their lowermost positions, similar to the positions shown in FIG. 9. At the bottom of the stroke, the annular shoulder 196 on the die center piston 190 is in engagement with and forms a stop for the annular spacer 198 on the top of the pressure sleeve 46' as a result of the selected air pressures within the chambers or passages 49' and 59'. Thus the height between the bottom of the die center nose 72' and the bottom surface of the pressure sleeve 46' is precisely established by the stop. As a result, the upper tooling shown in FIG. 16 produces a can end or shell 15 which has a precision dimension or height from the bottom of the countersink 18 (FIG. 13) to the top of the crown 26. Furthermore, this precision dimension or height is maintained or remains constant during high speed operation of the press and tooling after arriving at operting temperature as well as during start up of the press and before the press changes due to thermal expansion and operational dynamics. Also, the precision height may be easily changed simply by changing the thickness of the spacer 198.

Figure 17:
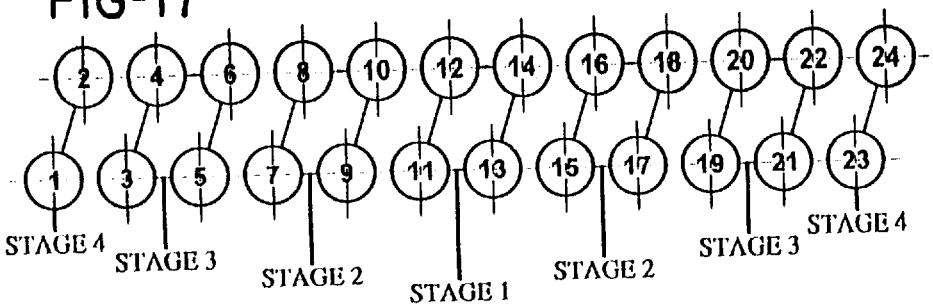
FIG. 17 is a diagrammatic plan view of a series of tooling stations arranged in stages which are operated in sequential time relation.

Referring to FIG. 17, the tooling stations described above in connection with FIGS. 1 and 16 are preferably divided into stages such as stages 1, 2, 3 and 4 with stage 1 including four shell forming stations 11–14, stage 2 including eight shell forming stations 7–10 and 15–18, stage 3 including eight shell forming stations 3–6 and 19–22, and stage 4 including four shell forming stations 1, 2, 23 and 24. The corresponding die core rings 95 and panel punches 125 for the stations at each stage are located at a slightly different elevation from the level of the stock 150 and from the corresponding tooling components at each of the other stages. Thus the forming of the shells at the different stages occurs at different time intervals within the same press stroke. As a result, the shells produced at the tooling stations in stage 1 are completed slightly before the shells are completed in stage 2 which are slightly before the shells of stage 3 are completed, with the last shells to be completed at the tooling stations of stage 4. The slightly different elevations of the cut edges 84, die core rings 95 and panel punches 125 at the different stages are preferably obtained by machining the shoulders or counterbores within the retainers 80 which support the die core rings 95 and the cut edges 84. However, the different elevations may also be obtained by using different thickness annular shims under these tooling components or by machining the bottom surfaces of the tooling components to provide them with different heights.

Figure 18:
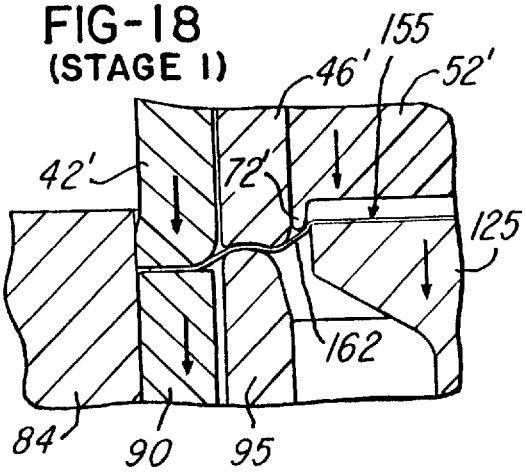
FIGS. 18 and 19 are fragmentary section views similar to FIG. 4 and illustrating the staggered relation of the tooling at stages 1 and 4 of FIG. 17 to provide sequential forming of the shells.
Figure 19:
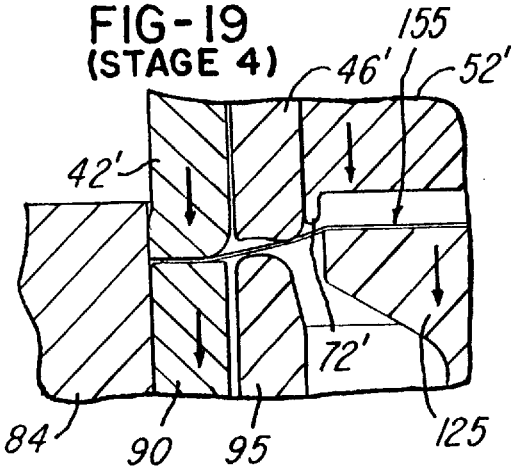

As apparent from FIGS. 18 and 19, the upper tooling components contact the sheet metal on the lower tooling components at staggered time intervals to provide for sequential forming of the shells and for significantly reducing the shock or dynamic loading on the press frame and components of the press. While FIGS. 18 and 19 illustrate the relationship of the tooling components at stages 1 and 4, it is understood that the tooling components for stages 2 and 3 are at different elevations between the elevations shown in FIGS. 18 and 19.

From the drawings and the above description, it is apparent that the method and apparatus of the present invention provide desirable features and advantages. As one advantage, the tooling assembly of the invention is adapted for use on a single action press with each shell being completely formed at each tooling station without any significant thinning of the sheet material. The method and apparatus also provide for producing the strongest shell from the thinnest gauge material for obtaining more economical production of the shells. That is, the method permits a significant reduction in the sheet metal thickness while increasing the strength of the shell to withstand substantial pressure within the container without buckling or deforming the shell.

More specifically, the panel radius 22 and countersink radius 21 (FIG. 14) may be minimized by rolling of the material around the nose portion 72 and between the nose portion and the closely spaced panel punch while the die center 52 and panel punch are moving upwardly. The capability to produce these minimum radiuses and the ironing or coining of the panel wall 17 provides for increasing the axial length of the cylindrical panel wall 17 and to move metal into the panel radius 22, thereby increasing the strength of the shell 15 against buckling. Also, the formation of the panel wall 17 and the countersink 18 in this manner around and within the nose portion 72 provides for a precision and uniform countersink radius and avoids stretching and thinning of the thin sheet metal around the panel radius and countersink radius so that a thinner gage sheet metal may be used.

As also mentioned above, the small clearance over metal thickness between the nose portion 72 and the inner cylindrical surface 98 of the die core ring 95 provides for producing the inward bow or ridge 171 within the chuckwall 24. This reinforces the chuckwall and permits shifting the panel wall 17 to a precisely vertical or cylindrical configuration by the subsequent operation during seaming, as shown in FIGS. 14 and 15. In addition, the modified upper tooling shown in FIG. 16 is effective to produce shells with a precision height dimension, especially during startup of the press. Furthermore, by locating the lower tooling components or the upper tooling components at the multiple stations or stages of stations at slightly different elevations, the shells are sequentially formed with each stroke of the press. This significantly reduces the dynamic loading on the mechanical press so that the press may be operated at a higher speed for a higher production rate without overloading the press.

While the method and form of apparatus herein described constitute a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

1. In a method of forming a batch of can end walls or shells from a flat metal sheet at a series of tooling stations on a mechanical press having a die shoe supported for reciprocating movement and with each stroke of the die shoe, the tooling stations having the same tooling components at each station and each shell including a center panel connected to an annular crown by an annular panel wall, an annular countersink and a tapered annular chuckwall, the method including the steps of blanking a series of disks from the sheet at the tooling stations with corresponding tooling components, moving annular portions of the disks axially relative to corresponding center portions of the disks with corresponding tooling components including a die center within a surrounding pressure sleeve at each tooling station for forming the annular countersinks and chuckwalls of the corresponding shells at the tooling stations, the improvement comprising the steps of supporting the die center at each station for axial movement within the corresponding pressure sleeve, biasing each die center to a fixed position with respect to the corresponding pressure sleeve, and positioning corresponding tooling components at the tooling stations at slightly different spacing from a surface supporting the metal sheet for sequentially forming the center panels within the disks at the tooling stations for reducing the dynamic loading on the press.

2. A method as defined in claim 1 wherein the tooling components at each station include a die core ring, and including the step of positioning the die core rings at the tooling stations at slightly different spacings relative to the surface supporting the metal sheet for sequentially forming the chuckwalls of the shells at the tooling stations.

3. A method as defined in claim 1 wherein the tooling components at each station include a panel punch, and including the step of positioning the panel punches at the tooling stations at slightly different spacings relative to the surface supporting of the metal sheet for sequentially forming the countersinks and panel walls of the shells at the tooling stations.

4. A method as defined in claim 1 wherein the tooling components at each station include an annular cut edge die, and including the step of positioning the cut edge dies at the tooling stations at slightly different elevations relative to the surface supporting the metal sheet for sequentially blanking the series of disks at the tooling stations.

5. A method of forming a batch of can end walls or shells from a flat metal sheet at a series of tooling stations on a mechanical press, each shell including a center panel connected to an annular crown by an annular panel wall, an annular countersink and a tapered annular chuckwall, the method comprising the steps of blanking a series of disks from the sheet at the tooling stations, gripping annular portions of the disks between corresponding pressure sleeves and die core rings at the tooling stations, moving the annular portion of each disk axially with the corresponding pressure sleeve and die core ring relative to a center portion of the disk, pressing the center portion of each disk with a panel punch disposed within the die core ring at each tooling station and a die center supported within the pressure sleeve at each tooling station to define the center panel, moving the center panel of each disk with the corresponding die center and panel punch to form the countersink, chuckwall and panel wall of each disk, supporting the die center at each station for axial movement within the corresponding pressure sleeve, and biasing each die center to a fixed position with respect to the corresponding pressure sleeve.

6. A method as defined in claim 5 and including the step of positioning the die core rings at the tooling stations at slightly different spacings relative to a surface supporting the metal sheet for sequentially forming the crowns of the shells at the tooling stations.

7. A method as defined in claim 5 and including the step of positioning the panel punches at the tooling stations at slightly different spacings relative to a surface supporting of the metal sheet for sequentially forming the countersinks and panel walls of the shells at the tooling stations.

8. A method as defined in claim 5 and including the step of positioning cut edge dies at the tooling stations at slightly different elevations relative to a surface supporting the metal sheet for sequentially blanking the series of disks at the tooling stations.

9. Apparatus adapted for forming a batch of can end walls or shells from a flat metal sheet at a series of tooling stations on a mechanical press including a die shoe supported for reciprocating movement, each shell including a center panel connected to an annular crown by an annular panel wall, an annular countersink and a tapered annular chuckwall, said apparatus comprising an annular blank die supported at each said station by said die shoe for movement therewith, an annular first pressure sleeve supported at each station and opposing the corresponding said blank die for blanking a batch of disks from the sheet, an annular second pressure sleeve member within said blank die at each said tooling station and opposing an annular die core ring member within the corresponding said first pressure sleeve, a die center member within said second pressure sleeve member at each said tooling station and opposing a panel punch member disposed within the corresponding said die core ring member, each said panel punch member having an end surface opposing the corresponding said die center member, corresponding said members at said tooling stations being positioned at slightly different spacings from a surface supporting the metal sheet to provide for sequentially forming the shells at said stations with each stroke of said die shoe for significantly reducing the dynamic loading on the press, each of said die center members being supported for axial movement relative to the corresponding said blank die and said second pressure sleeve member, and means for biasing each said die center member to a fixed position with respect to the corresponding said second pressure sleeve member.

10. Apparatus as defined in claim 9 wherein said tooling stations are arranged in a plurality of stages with a plurality of said tooling stations at each stage.

11. Apparatus as defined in claim 9 wherein said die core ring members and the corresponding said panel punch members are positioned said slightly different spacings from said surface supporting the metal sheet.

12. Apparatus adapted for forming a batch of can end walls or shells from a flat metal sheet at a series of tooling stations on a mechanical press including a die shoe supported for reciprocating movement, each shell including a center panel connected to an annular crown by an annular panel wall, an annular countersink and a tapered annular chuckwall, said apparatus comprising an annular blank die supported at each said station by said die shoe for movement therewith, an annular first pressure sleeve supported at each station and opposing the corresponding said blank die for blanking a batch of disks from the sheet, an annular second pressure sleeve member within said blank die at each said tooling station and opposing an annular die core ring member within the corresponding said first pressure sleeve, a die center member within said second pressure sleeve member at each said tooling station and opposing a panel punch member disposed within the corresponding said die core ring member, each said panel punch member having an end surface opposing the corresponding said die center member, each of said die center members being supported for axial movement relative to the corresponding said blank die and said second pressure sleeve member, and means for biasing each said die center member to a fixed position with respect to the corresponding said second pressure sleeve member.

13. A method of forming a batch of can end walls or shells from a flat metal sheet at a series of tooling stations on a mechanical press, each shell including a center panel connected to an annular crown by an annular panel wall, an annular countersink and a tapered annular chuckwall, the method comprising the steps of blanking a series of disks from the sheet at the tooling stations, sequentially gripping annular portions of the disks between corresponding pressure sleeves and die core rings at the tooling stations for significantly reducing the dynamic loading on the press, moving the annular portion of each disk axially with the corresponding pressure sleeve and die core ring relative to a center portion of the disk, pressing the center portion of each disk with a panel punch disposed within the die core ring at each tooling station and into an annular nose portion of a die center supported within the pressure sleeve at each tooling station to define the center panel, supporting the die center at each station for axial movement within the corresponding pressure sleeve, biasing each die center to a fixed position with respect to the corresponding pressure sleeve, moving the center panel of each disk with the corresponding die center and panel punch to wrap an annular portion of each disk around the corresponding nose portion to form the countersink and the chuckwall against the corresponding die core ring, and forming the panel wall of each disk between the corresponding nose portion and the panel punch.

* * * * *